US005732629A

United States Patent [19]

Puschnerat et al.

[11] Patent Number: 5,732,629

[45] Date of Patent: Mar. 31, 1998

[54] ARRANGEMENT FOR RETAINING A CURVED SUPPORT

[75] Inventors: Helmut Puschnerat, Wachenheim; Peter Schröder, Hessheim, both of Germany

[73] Assignee: Koenig & Bauer-Albert Aktiengesellschaft, Wurzburg, Germany

[21] Appl. No.: 669,392

[22] PCT Filed: Jan. 18, 1995

[86] PCT No.: PCT/DE95/00057

§ 371 Date: Jul. 18, 1996

§ 102(e) Date: Jul. 18, 1996

[87] PCT Pub. No.: WO95/19264

PCT Pub. Date: Jul. 20, 1995

[30] Foreign Application Priority Data

Jan. 18, 1994 [DE] Germany ..... 44 01 201.2

[51] Int. Cl.[6] ..... B41F 1/28

[52] U.S. Cl. ..... 101/415.1

[58] Field of Search ..... 101/415.1

[56] References Cited

U.S. PATENT DOCUMENTS

| | | | |
|---|---|---|---|
| 2,204,928 | 6/1940 | Culver | 101/415.1 |
| 3,058,417 | 10/1962 | Nordin | 101/415.1 |
| 3,456,588 | 7/1969 | Brodie | 101/415.1 |
| 3,715,981 | 2/1973 | Huffman | 101/415.1 |
| 4,522,068 | 6/1985 | Bernauer et al. | 101/415.1 |
| 5,062,363 | 11/1991 | Reichel | 101/415.1 |
| 5,402,722 | 4/1995 | Schneider | 101/415.1 |

FOREIGN PATENT DOCUMENTS

| | | | |
|---|---|---|---|
| 253 977 A1 | 2/1988 | Germany | 101/415.1 |
| 40 05 093 | 6/1991 | Germany . | |
| 43 26 247 | 7/1994 | Germany . | |

*Primary Examiner*—Edgar S. Burr
*Assistant Examiner*—Leslie Grohusky
*Attorney, Agent, or Firm*—Jones, Tullar & Cooper, P.C.

[57] ABSTRACT

The two beveled ends of a sheet-shaped flexible support, such as a printing plate, are inserted in a slit in a plate cylinder. A bore extends laterally adjacent the slit and carries an inflatable hose. The hose can be inflated to apply a holding force against the plate ends positioned in the cylinder slit.

3 Claims, 1 Drawing Sheet

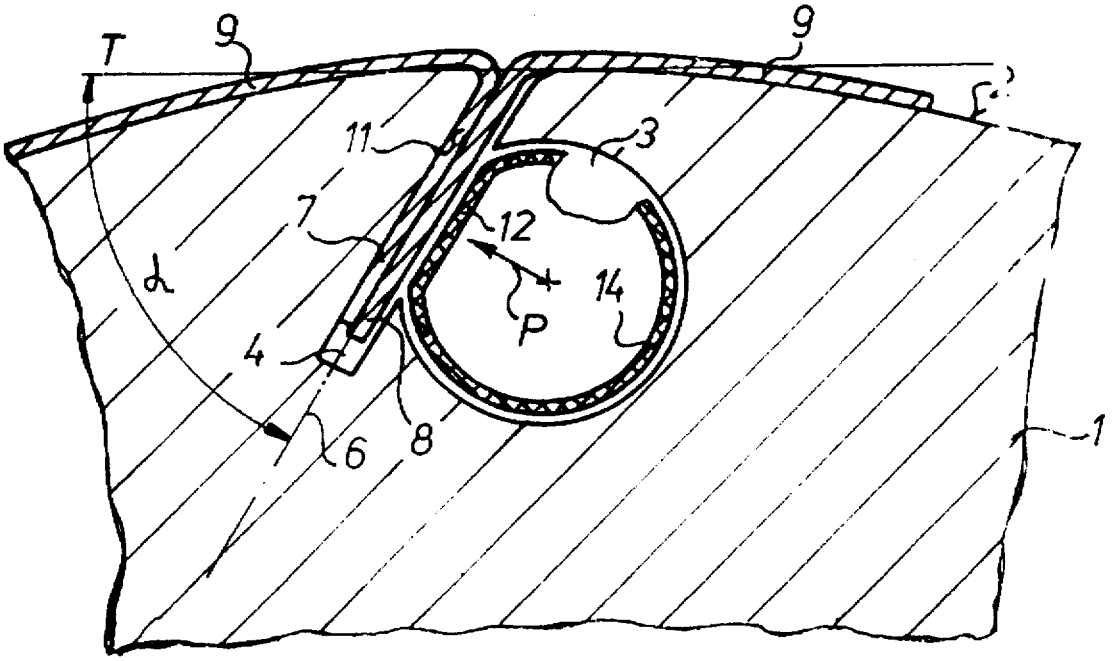
T
9
9
11
3
7
12
α
14
P
4
6
8
1

ARRANGEMENT FOR RETAINING A CURVED SUPPORT

FIELD OF THE INVENTION

The invention relates to an arrangement for retaining first and second beveled edges or ends of a sheet-shaped flexible support, such as an offset printing plate, in an insertion slit of a cylinder of a rotary printing press.

DESCRIPTION OF THE PRIOR ART

A prior art device which is usable for clamping a flexible printing plate on a cylinder of a rotary printing press has become known from DE 40 05 093 C1, wherein an eccentrically seated clamping spindle extends in an axis-parallel direction in a cylinder well of a printing cylinder. Two ends of a printing plate are clamped together between a wall of the cylinder well and the clamping spindle when the clamping spindle is rotated and thus presses the ends of the printing plate into a circular arc-shaped section of the cylinder well.

It is disadvantageous in connection with this prior art clamping device that the ends of the printing plates have permanent deformations because of being pressed into the circular arc-shaped section of the cylinder well. These deformations are an obstacle to the multiple use of the printing plates. Furthermore, the deformed ends are difficult to remove from the circular arc-shaped section of the cylinder well, since they adhere in a bead-like manner to this section.

SUMMARY OF THE INVENTION

It is the object of the present invention to provide a device for retaining the bent edges of a sheet-shaped support, for example a flexible printing plate, on a cylinder, by means of which the sheet-shaped support can be rapidly exchanged and its ends can be held without damage.

This object is attained in accordance with the invention by utilizing a printing plate support cylinder that is provided with an axially extending plate end receiving insertion slit. An axially extending hole or bore is situated adjacent the insertion slit. An inflatable hose is situated in this hole or bore. When the inflatable hose is provided with a pressurized fluid, it engaged the plate ends that have been inserted in the slit and holds them against a wall of the slit opposite the hose.

The following advantages are realized by means of the present invention: only the cutting of an axial bore in the vicinity of the surface of the printing cylinder is required for receiving the clamping device for the printing plate. The beveled edges of the printing plates are fed to the clamping device only by means of a slit extending tangentially in respect to the cross section of the axial bore. In the process, both ends of the printing plate lie on top of each other, so that the slit in the printing cylinder can be kept narrow on the one hand and, on the other, no ink can penetrate between both plate ends and so-called "conduit shocks" of the printing cylinder are prevented to the greatest extent. Furthermore, those means which make a rapid removal of the printing plate possible, wherein the beveled or bent edges of the printing plate are still undamaged following clamping or retaining and are not deformed, are used for retaining the plate ends. It is also possible to hold printing blankets on cylinders by means of this device.

BRIEF DESCRIPTION OF THE DRAWING

The invention will be explained in more detail below by means of an exemplary embodiment. The sole drawing FIGURE shows a cross section through a preferred embodiment of a device in accordance with the present invention.

DESCRIPTION OF THE PREFERRED EMBODIMENT

A printing cylinder 1 is provided with an axis-parallel hole or bore 3, extending in an axis-parallel direction in the vicinity of the surface 2 of cylinder 1 and with bore 3 having a generally circular cross section, for example in the shape of a segment of a circle. A straight slit 4 , which is a plate end insertion slit of a preferably rectangular cross section about a central axis 6 which is inclined at an angle $\alpha$ with respect to a tangent line T which is tangent with the surface 2 of cylinder 1 at the point where slit 4 intersects cylinder surface 2, extends from the surface 2 of the printing cylinder 1 in a plane along a chord of the printing cylinder cross section. Laterally, for example on the right side, the slit 4 is connected with the hole or bore 3. The hole 3 can be embodied to be as long as the cylinder, but can also have, for example, a length equal to a lateral width of a printing plate so that the bore 3 may be embodied as a blind bore.

The slit 4 has first and second side walls and receives both ends 7, 8 of a printing plate 9 in such a way that these first and second beveled ends 7, 8 extend parallel to and touch each other in the areas of their inwardly facing sides. A first beveled plate end 7 lies with its outside face against a first cylinder side wall 11 of the slit 4, while a second beveled end 8 of the printing plate 9 laterally terminates with its outside face adjacent the hole or bore 3 which is connected to the second side wall of the slit 4. An expandable, inflatable hose 14 has been pushed into the axis-parallel hole 3 of the printing cylinder 1.

The hose 14 can be charged with a medium, for example compressed air, and is provided with a check valve, not shown, on at least one of its two faces or ends located in close proximity to the end faces of the printing cylinder 1. The check valve can be connected by means of a compressed air source, not shown, so that the hose 14 fills the axis-parallel hole or bore 3 and is pressed into the slit 4. A portion 12 of the hose 14 engages the outside face of plate end 8 with a force P presses the two plate ends 8, 7 against the left or first wall 11 of the slit 4, so that these two ends 7, 8 of the printing plate 9 are held in place. For releasing the printing plate 9 from the printing cylinder 1, the air escapes from the hose 14, for example by means of an also not shown venting device, for example at least one venting screw disposed on one end of the hose 14. It will be understood that the outer surface of the hose 14 will be in contact with the wall surface of the bore 3, particularly in its inflated state and that the plate end engaging portion 12 of hose 14 will be in contact with the outer face of the plate end 8. The spacing shown between the hose 14, the bore 3 and the plate end 8 in the sole drawing figure are merely for clarity of illustration.

It is also possible to use a fluid, for example oil or glycerin, for filling the hose, which fluid can be supplied to the hose under pressure by means of a feed line via the check valve.

It is furthermore also possible to arrange the axis-parallel hole 3 as well as the slit 4 extending tangentially with the hole 3 in an exchangeable insertion strip. This insertion strip can be disposed in a cylinder well of the printing cylinder 1 extending in the axial direction. The plate end engaging portion 12 of hose 14 will be caused to deform by its force of contact with plate end 8, as seen in the sole drawing figure. This force of contact will cause the portion 12 of the hose 14 to contact the outside surface of plate end 8 over a relatively large area.

We claim:

1. A device for retaining first and second beveled ends of a sheet-shaped support, without creating tension in said support, on a surface of a cylinder, said device comprising:

a support end insertion slit in said cylinder, said support end insertion slit being of a width essentially the same as a thickness of said first and second beveled ends and being generally rectangular in cross-section and extending into said cylinder from a surface of said cylinder at an acute angle with respect to a line which is tangent with said surface of said cylinder at a point where said support end insertion slit intersects said surface of said cylinder, said support end insertion slit having first and second side walls and being sized to cause inwardly facing sides of each of said first and second beveled ends of said support inserted in said support end insertion slit parallel to each other to touch each other;

a bore extending in an axial direction in said cylinder, said bore being laterally connected with said second side wall of said support end insertion slit and having a cross-section in the shape of a segment of a circle, said bore being located within said cylinder in the vicinity of said surface of said cylinder; and an inflatable hose positioned in said bore, said inflatable hose being inflatable to fill said bore and to engage an outside face of said second beveled end of said support and to press said inwardly facing sides of said first and second beveled ends of said support together and to clamp an outside face of said first beveled end of said support against said first side wall of said support end insertion slit.

2. The device in accordance with claim 1, wherein compressed air is used as an inflation medium for said hose.

3. The device in accordance with claim 1, wherein a liquid is used as an inflation medium for said hose.

* * * * *